US006675543B2

(12) United States Patent
LeMert

(10) Patent No.: US 6,675,543 B2
(45) Date of Patent: Jan. 13, 2004

(54) GLASS BLOCK STRUCTURE WITH PHENOLIC RESIN FRAMEWORK

(76) Inventor: Steven G. LeMert, 7306 N. Central Ave., Phoenix, AZ (US) 85020

( * ) Notice: Subject to any disclaimer, the term of this patent is extended or adjusted under 35 U.S.C. 154(b) by 0 days.

(21) Appl. No.: 09/887,895

(22) Filed: Jun. 22, 2001

(65) Prior Publication Data

US 2003/0005655 A1 Jan. 9, 2003

(51) Int. Cl.[7] ..... E04C 1/42
(52) U.S. Cl. ..... 52/308
(58) Field of Search ..... 52/306, 307, 308, 52/204.6, 475, 762, 764, 384, 385

(56) References Cited

U.S. PATENT DOCUMENTS

| | | | | |
|---|---|---|---|---|
| 2,141,000 | A | * | 12/1938 | Hohl |
| 2,835,623 | A | * | 5/1958 | Vincent et al. |
| 2,941,393 | A | * | 6/1960 | McDavitt et al. |
| 4,115,964 | A | * | 9/1978 | Montrouil ..... 52/106 |
| 4,839,229 | A | | 6/1989 | Jellinek et al. |
| 4,916,876 | A | * | 4/1990 | Schuyler |
| 4,965,975 | A | * | 10/1990 | Schwarz |
| 5,010,704 | A | * | 4/1991 | Thompson |
| 5,014,479 | A | * | 5/1991 | Yeh et al. |
| 5,031,372 | A | | 7/1991 | McCluer |
| 5,368,906 | A | | 11/1994 | Ferrier nee Pegot et al. |
| 5,430,985 | A | * | 7/1995 | Coleman |
| 5,448,864 | A | * | 9/1995 | Rosamond |
| 5,485,702 | A | | 1/1996 | Sholton |
| 5,640,819 | A | | 6/1997 | Wirkus et al. |
| 5,655,345 | A | * | 8/1997 | Thompson |
| 5,806,263 | A | * | 9/1998 | Coleman |
| 5,845,443 | A | | 12/1998 | Wirkus et al. |

FOREIGN PATENT DOCUMENTS

| | | | |
|---|---|---|---|
| EP | 356374 | * | 2/1990 |

* cited by examiner

*Primary Examiner*—Blair M. Johnson
(74) *Attorney, Agent, or Firm*—Schmeiser, Olsen & Watts

(57) ABSTRACT

A glass block structure supported by a flexible phenolic resin framework is disclosed. The phenolic resin framework is bonded to the individual glass blocks with an adhesive substance that is placed so as to lie at or near the corners of the blocks. The phenolic resin that makes up the supporting framework may advantageously be formed in a pultrusion process wherein the resin is embedded with glass-like strands. Further heat-tolerance and adhesion may be obtained from the use of a high-heat tolerant putty applied between the phenolic resin and the glass blocks. The flexibility of the phenolic resin allows the block structure to be preassembled and then transported to an installation site as a single, ready-to-install unit.

15 Claims, 5 Drawing Sheets

GLASS BLOCK STRUCTURE WITH PHENOLIC RESIN FRAMEWORK

BACKGROUND OF THE INVENTION

1. Technical Field

This invention generally relates to a glass block structure, and more specifically relates to a heat-tolerant glass block structure that incorporates a phenolic resin framework that allows the structure to be pre-assembled and shipped to an installation location.

2. Background Art

Glass has many qualities that make it well-suited for use in windows, including transparency or translucency, hardness, imperviousness to the natural elements, insulating properties, and an ability to be formed into various shapes. Windows, walls, and other partitions have long been formed from glass blocks which admit the passage of light but, because of their thickness, do not permit a clear view of objects beyond the glass. Thus glass block is ideal for any situation or setting where both natural illumination and privacy are important.

Individual glass blocks are assembled into glass block structures by attaching a material to the blocks that bonds the blocks together. This material may be a spacer made of wood, metal or plastic adapted to provide a trough or groove between blocks into which caulking or mortar is placed. Mortar materials have been developed that tolerate high temperatures, and these are especially useful for their fire-resistant properties.

The construction of a glass brick structure using mortar, however, is a task that requires a great deal of skill and experience. Without such experience, it is difficult to properly position the glass blocks so that they lie in level, straight courses and so that they are securely held in place within the structure. The construction must also be carefully timed so that the mortar is not subjected to excessive weight before it is able to withstand such stress without being forced from between the blocks. These requirements substantially increase the expense and difficulty that attends the installation of a glass block structure.

Some manufacturers offer pre-assembled glass block structures that may be shipped to a building site ready to be installed. Fire-resistant mortars, however, are too fragile to survive such transportation, and must currently be installed on-site by a mason who has the necessary skill to perform the task. Builders are reluctant to permit this because it is very time-consuming and expensive. Yet fire resistance is often a very important and desirable feature in a glass block structure, and in many instances is even required by the building code.

DISCLOSURE OF INVENTION

Therefore, there existed a need to provide a heat-tolerant, fire-resistant glass block structure that may be pre-assembled and shipped in a unitary piece to the installation site. According to the present invention, a glass block structure is supported by a phenolic resin framework. This framework is bonded to the individual glass blocks with an adhesive substance that is placed so as to lie at or near the corners of the blocks. The phenolic resin that makes up the framework may advantageously be formed in a pultrusion process wherein the resin is embedded with glass-like strands. Further heat-tolerance and adhesion may be obtained from the use of a high-heat tolerant putty applied between the phenolic resin and the glass blocks.

The glass block structure includes a phenolic resin frame around its perimeter that serves both to stabilize and support the structure during transportation and to assist with the installation process. An I-beam may also be included in the structure for the latter purpose, and both frame and I-beam are in some places required by the building code. If a fire were to engulf a glass block structure configured according to the present invention, the adhesive substance on the side of the structure facing the fire may be consumed or compromised by the heat, while the adhesive on the side opposite the structure from the fire, because of the heat tolerance of the phenolic resin, is protected to the point that it does not burn away. The phenolic resin, therefore, greatly enhances safety and decreases fire damage as it allows the adhesive substance to remain in place and hold the glass block structure together. A stable glass block structure helps prevent or slow the spread of a fire.

The foregoing and other features and advantages of the invention will be apparent from the following more particular description of specific embodiments of the invention, as illustrated in the accompanying drawings.

BRIEF DESCRIPTION OF DRAWINGS

Certain embodiments of the present invention will hereinafter be described in conjunction with the appended drawings, where like designations denote like elements.

MODES FOR CARRYING OUT THE INVENTION

The present invention involves a glass block structure supported by a phenolic resin framework. The phenolic resin that makes up this framework may be bonded to individual glass blocks with an adhesive substance that is placed so as to lie at or near the corners of the blocks. The phenolic resin may advantageously be formed in a pultrusion process wherein the resin is embedded with glass-like strands. Further heat-tolerance and adhesion may be obtained from the use of a high-heat tolerant putty applied between the phenolic resin and the glass blocks.

Figure 1:
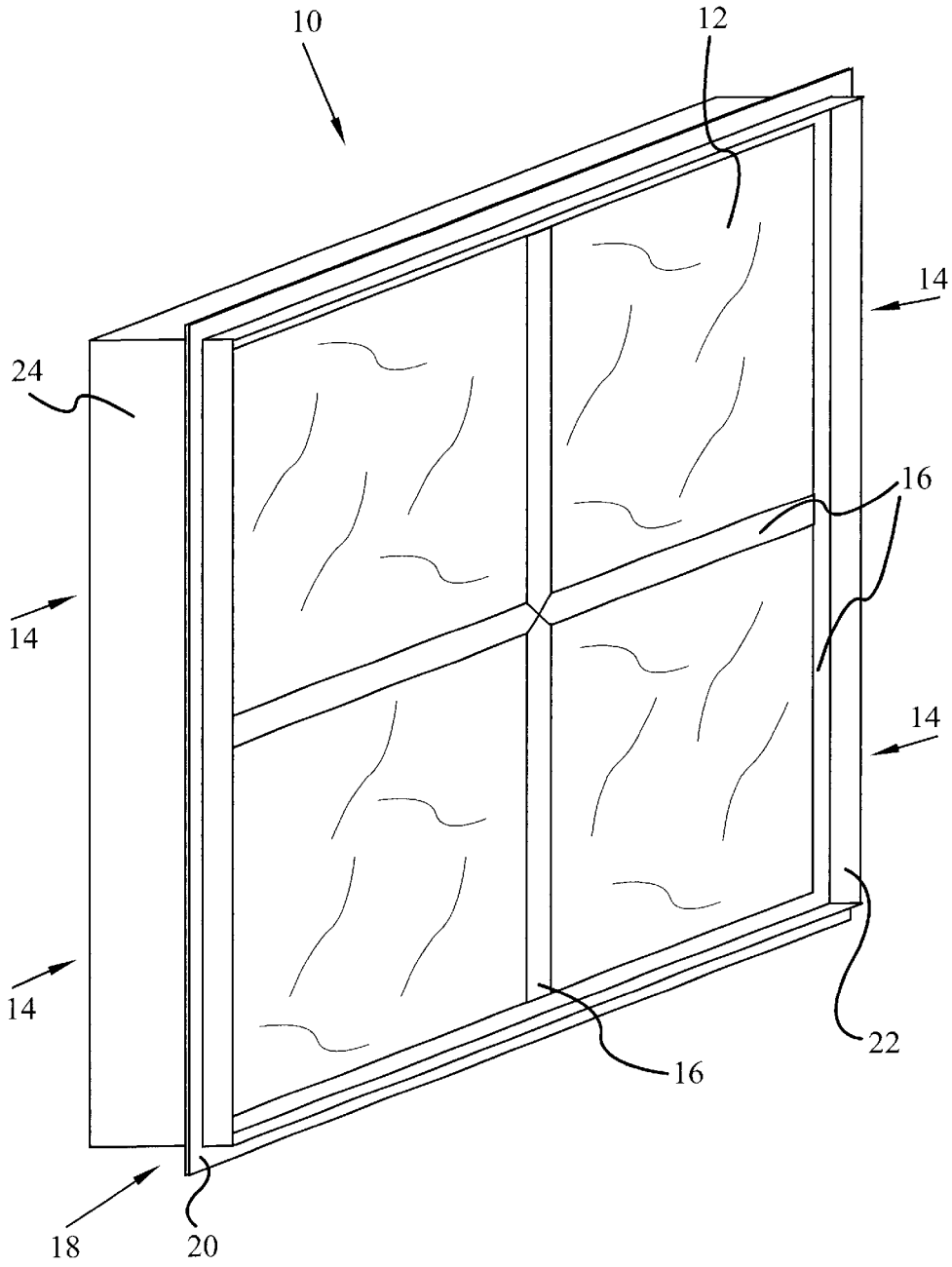
FIG. 1 is a perspective view of the glass block structure of the present invention.

Referring now to the figures, and in particular to FIG. 1, a glass block structure 10 is composed of individual glass blocks 12 arranged in horizontal rows or courses 14. Courses 14 are arranged in vertical fashion one atop another until glass block wall 10 achieves a desired height. A phenolic resin strip 16 is placed near the perimeter of each individual glass block 12. As will be readily apparent to one of ordinary skill in the art, other substances, such as polyester resin, are similarly heat-resistant and flexible, and may be used in the present invention in place of phenolic resin. Thus, although the support framework for glass block structure 10 will be referred to herein as being constructed of phenolic resin, it will be understood by one of ordinary skill in the art that other substances are also possible and within the scope of the invention. Within a single glass block structure 10, individual glass blocks 12 are conventionally of substantially similar size and shape, and are aligned with each other such that there is little or no offset or overlap between a glass block 12 in one course 14 and the corresponding block 12 in the other courses 14 above or below the first course 14. Phenolic resin strip 16 may thus be a substantially straight piece for the extent of its length. An installation frame 18 surrounds glass blocks 12. Installation frame 18 comprises nailing fin 20, and may comprise a stucco stop 22, and a rear edge support 24. Stucco stop 22 may alternatively be a brick molding, or other structure.

Glass block structure 10 may comprise any number of glass blocks 12 arranged in any number of courses 14, where courses 14 themselves may contain any number of glass blocks 12. Conventionally, every course 14 within a single glass block structure 10 will contain an identical number of glass blocks 12. Phenolic resin strips 16 along with installation frame 18, form a supporting framework for the glass blocks 12 in glass block structure 10. An adhesive material, not shown in FIG. 1, bonds glass blocks 12 to installation frame 18. Phenolic resin strips 16 and installation frame 18 are fire and heat resistant, as further discussed below, and offer some protection to glass block structure 10 and its components under high-heat conditions.

In one embodiment of the present invention, the supporting framework includes hooks or tabs adapted to stabilize glass blocks 12, and hold blocks 12 in place in case of an event, such as a fire, that would tend to destabilize structure 10. The use of and method of manufacture of these tabs is known, and examples may be found in U.S. Pat. No. 5,031,372 to McCluer (Jul. 16, 1991).

The American Society for Testing and Materials (ASTM) has developed a test for the fire resistance of window assemblies known as the Positive Pressure Fire Test of Window Assemblies. To pass this test, a glass block assembly must remain in the test frame for the duration of the test without any flaming occurring on the unexposed face of the test assembly and without developing any through-openings in the individual glass blocks, in the joints between the glass blocks, or between the glass blocks and the test frame. During the ASTM Fire Test, a glass block assembly is exposed to the temperatures indicated in the following table:

| Time Elapsed Since Beginning of Test | Temperature (° F.) |
|---|---|
| 0 min | 68 |
| 5 min | 1000 |
| 10 min | 1300 |
| 30 min | 1550 |
| 1 hr | 1700 |
| 2 hrs | 1850 |
| 4 hrs | 2000 |
| 8 hrs or over | 2300 |

The present invention encompasses glass block assemblies having fire and heat resistance ratings of all descriptions, and various support framework substances, such as phenolic resin and polyester resin, will respond differently to the ASTM fire test. Advantageously, the heat-resistant properties of the phenolic resin in strips 16 and frame 18 are such that glass block structure 10 can withstand for at least several minutes the high temperatures experienced during a fire. In particular, in one conventional embodiment of the invention, the adhesive substance that bonds glass blocks 12 to installation frame 18, if it is on the side of glass block structure 10 opposite the fire, is able to come through the fire intact.

Glass blocks are manufactured by a number of companies. One of these is the Pittsburgh Corning Corporation of Pittsburgh, Pa., which, as is typical of glass block manufactures, offers a wide variety of face patterns and finishes, block shapes, and product specifications. Glass blocks 12 used by the present invention may be those manufactured by any manufacturer. Regardless of their source, all glass blocks are made by fusing together pressed and molded glass halves. This construction will be further discussed in connection with FIG. 2.

Installation frame 18, which includes nailing fin 20, (as is also visible in FIG. 5), stucco stop or brick molding 22, and rear edge support 24, may be composed, like strips 16, of phenolic resin. Because of the heat-resistant properties of the phenolic resin discussed above, its presence in installation frame 18 may increase the heat-resistance of glass block structure 10.

One feature of the present invention is its ability to be pre-assembled and then shipped in one unitary piece to a construction site. Traditional mortar, long used to support and bond together several glass blocks in a glass block structure, is brittle and cannot withstand the strain of transportation without cracking or sustaining other damage. In contrast, the phenolic resin and adhesive of the present invention are flexible and can bend and flex in reaction to pressures experienced during transport. Members of the glass block structure are thus able to move slightly with respect to each other without breaking during transportation. Because of this, glass block structure 10 may be built to a customer's specifications and then shipped as a unit in a ready-to-install piece to a location of the customer's choice.

The phenolic resin used in strips 16 and frame 18 may be formed through a pultrusion process wherein the phenolic resin is embedded with glass-like strands. In one embodiment of the present invention, the glass-like strands may be fiberglass. The pultrusion process, as will be apparent to one of ordinary skill in the art, involves the pulling of a product through a die. With respect to the present invention, the pultrusion process may involve fiberglass strands or mats which are fed into and pulled through a die while the phenolic resin, in liquid form, is poured over them. The die itself then may be heated, thus solidifying the fiberglass and resin mixture into a finished product having a desired shape. A person of ordinary skill in the art will recognize that the foregoing description is illustrative only, and that there may be other processes or methods that may be substituted.

Figure 2:
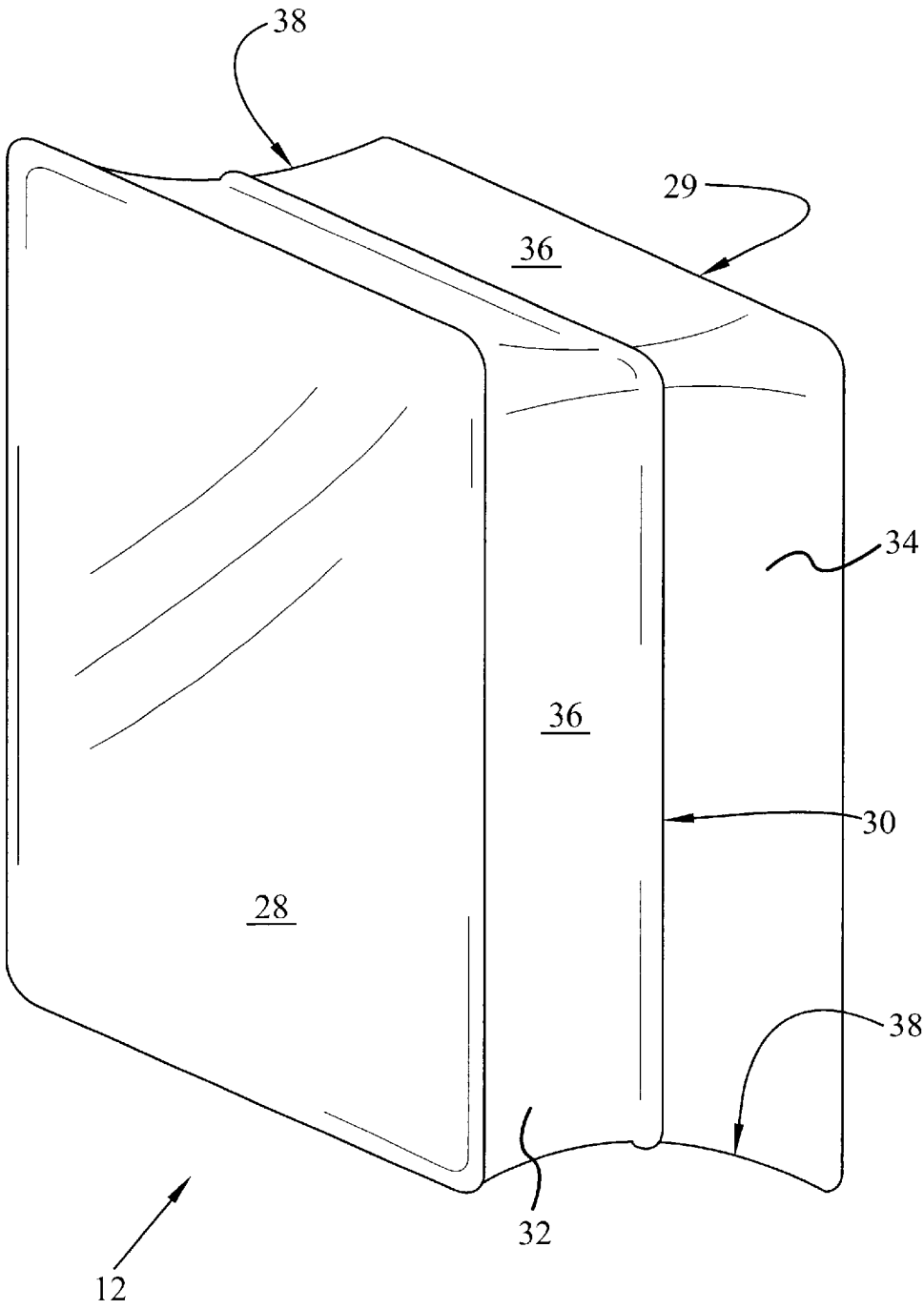
FIG. 2 is a perspective view of a single glass block.

Referring now to FIG. 2, a single glass block 12 comprises a front half 32 and a back half 34. Front half 32 and back half 34 are first molded into the proper shape then pressed together until they fuse. A seam 30 indicates the fusion location. Seam 30 thus girdles glass; block 12 substantially at the midpoint of its thickness. A front face 28, in a conventional embodiment of glass block 12, is substantially square, although other shapes are possible, including, but not limited to, rectangular, hexagonal, octagonal, triangular, and other shapes. Opposite front face 28 is a back face 29, not visible in FIG. 2, that matches or nearly matches front face 28 in its dimensions and composition. A recessed surface 36, the curvature of which is made apparent by lines 38, extends from front surface 28 to seam 30, and from seam 30 to back surface 29. Recessed surface 36 allows any protruding features of phenolic resin strips 16 to fit between phenolic resin strips 16 and glass block 12. Because recessed surface 36 comprises all four sides of glass block 12, phenolic resin strips 16 may fit closely against each side of glass block 12.

Figure 3:
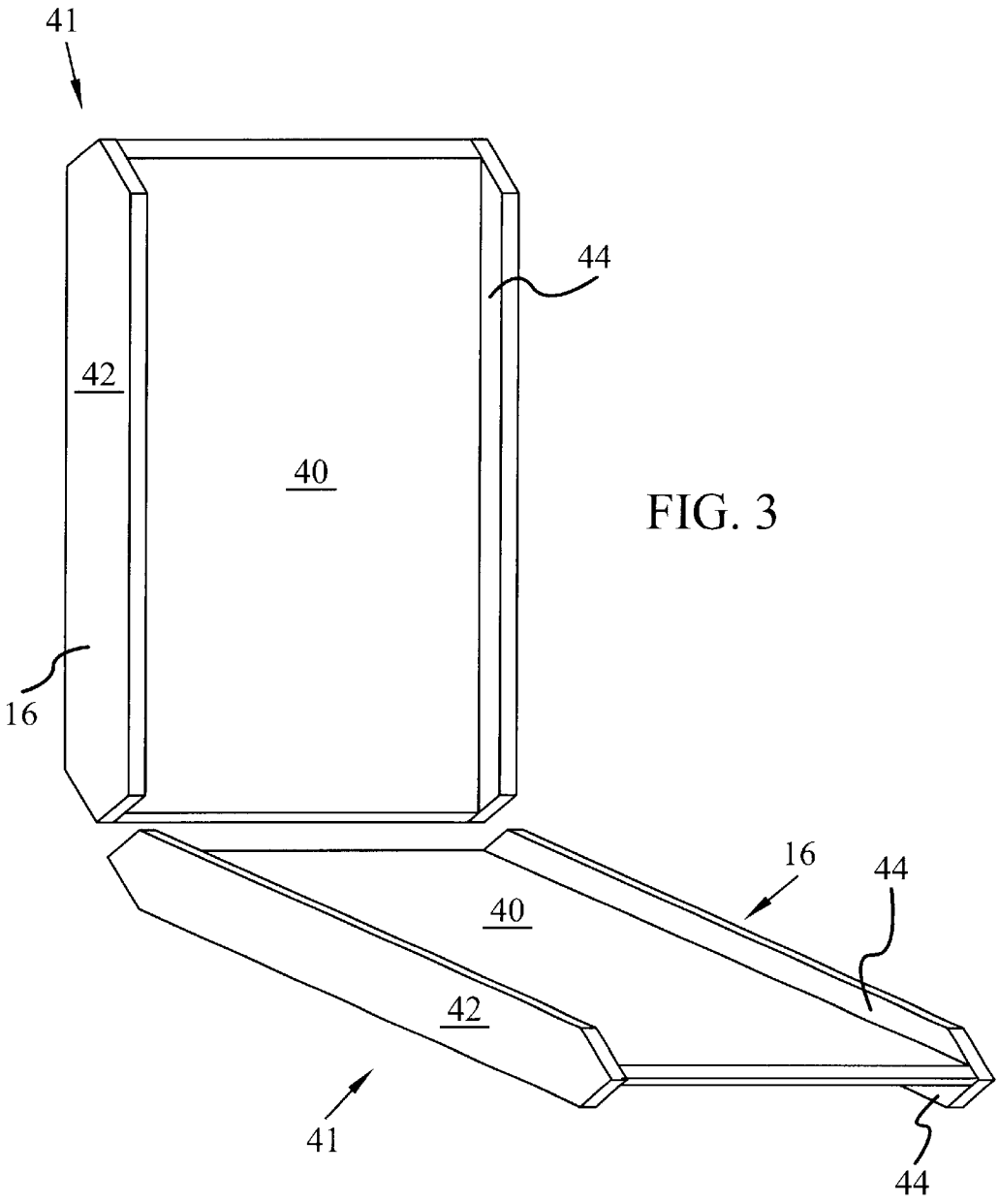
FIG. 3 is a view of the phenolic resin interior support framework.

Referring now to FIG. 3, phenolic resin strips 16 are shown attached to phenolic resin trays 40, forming a support piece 41. In the pictured embodiment, support pieces 41 are formed of two phenolic resin strips 16 that sandwich a rectangular phenolic resin tray 40. It should be understood that in one particular embodiment, support pieces 41 comprise one pultruded piece and as such contain no components attached in a process separate from the formation process. Other configurations of tray 40, and of support piece 41, are also possible as will be apparent to those of ordinary skill in the art. For example, support pieces 41 may in one embodiment comprise a hollow pultrusion, which may be stronger than a solid construction. Any one, or any combination, of resin strips 16, no matter where, they are located within glass block structure 10, may comprise the hollow pultrusion spoken of.

Phenolic resin strips 16 have an outside surface 42 and an inside surface 44. Outside surface 42 is the surface of phenolic resin strip 16 visible in FIG. 1. Inside surface 44 is the surface that is adjacent to glass block 12. In the configuration of FIG. 3, a glass block 12 would rest in and be supported by the horizontal support piece 41, with back surface 29 of glass block 12 (see FIG. 2) adjacent to inside surface 44 of phenolic resin strip 16. The vertical support piece 41 would then lie along a vertical side of glass block 12. The positioning of glass block 12 within phenolic resin tray 40 is more clearly shown in FIG. 4.

Support pieces 41 and their components may have various dimensions, and it will be readily understood by one of ordinary skill in the art that the following dimensions are given by way of illustration and not of limitation. Phenolic resin strip 16 may in one embodiment have a height of 0.400 plus or minus 0.005 inches and a thickness of approximately 0.100 inches. It is advantageous to make the thickness of phenolic resin strip 16 as small as possible. The short dimension of phenolic resin tray 40, in the embodiment under discussion, measures 3.200 plus or minus 0.010 inches and the thickness of tray 40 is 0.100 plus or minus 0.005 inches.

Figure 4:
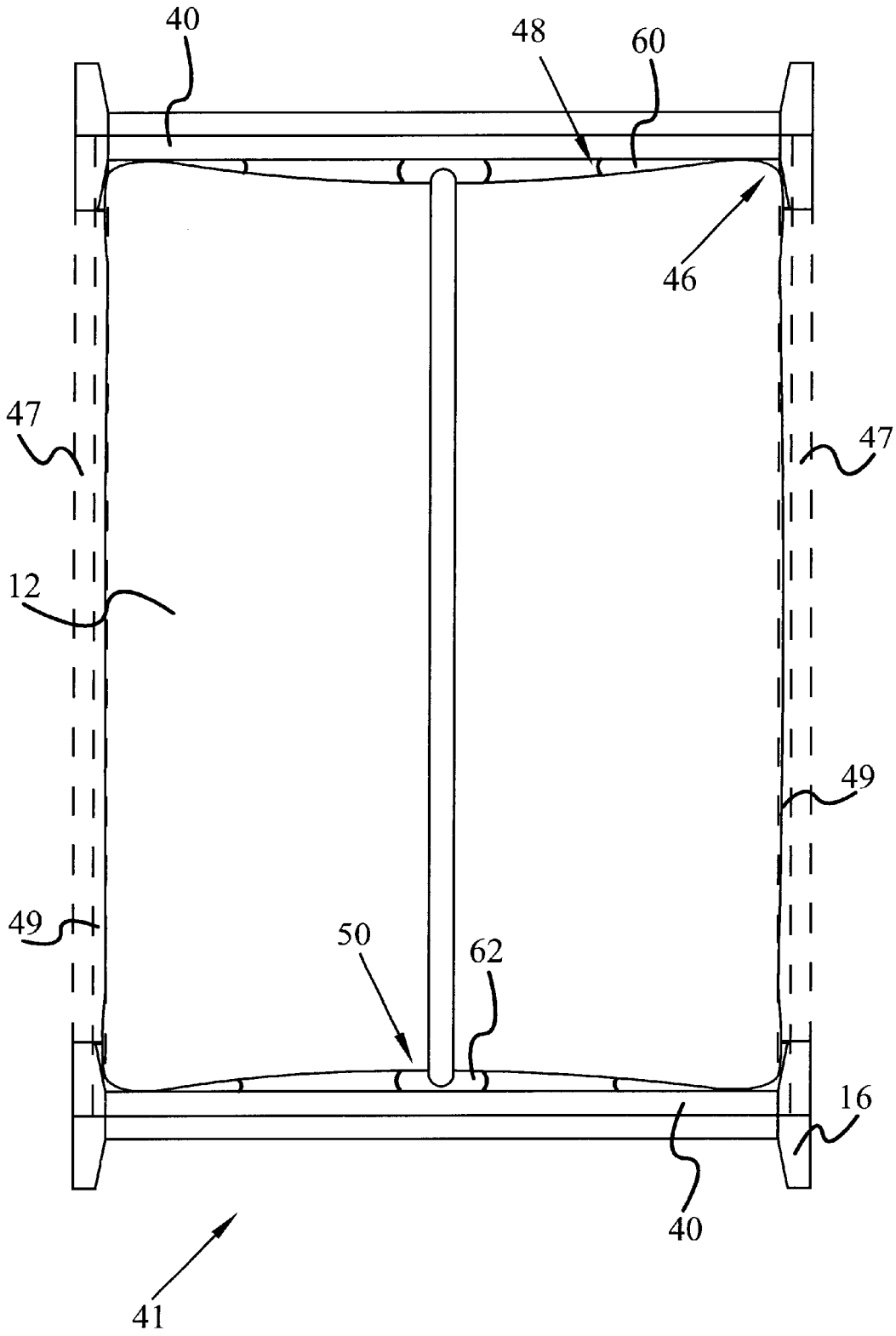
FIG. 4 is a side view of a glass block within the phenolic resin framework.

FIG. 4 shows glass block 12 situated between support pieces 41. Because this is a side view, seam 30 is visible running down the center of glass block 12. A vertical support piece 41 has been omitted in FIG. 4 so as to increase the clarity of the figure, but would, if shown, comprise a phenolic resin tray 40 covering substantially the same area as is occupied by the visible portion of glass block 12. Dotted columns 47 indicate the location of phenolic resin strips 16 that would accompany the omitted tray 40. Dotted lines 49 indicate the position of the corresponding phenolic resin strips 16 from a similarly positioned support piece 41 (not shown) on the far side of the glass block 12 pictured.

Adhesive substance 60 may be applied in one embodiment of the invention between glass block 12 and support pieces 41 at corners 46. Adhesive 60 holds glass block structure 10 together by bonding glass blocks 12 to support pieces 41. Silicon is one such adhesive substance 60 that works well in conjunction with the present invention, although it will be understood by those skilled in the art that any adhesive substance 60 capable of withstanding high heat may be substituted. When the silicon is applied at corners 46 it experiences pressure caused by the presence of glass block 12 and spreads out along phenolic resin tray 40 to a point roughly in the vicinity of the location indicated by reference numeral 48. In a particular embodiment of the invention, silicon is applied at each of the corners 46 of glass block 12.

In one embodiment of glass block structure 10 high heat-resistant putty 62 is placed between glass block 12 and phenolic resin tray 40. One example of heat-resistant putty 62 that may be used is that manufactured by Unifrax Corporation, headquartered in Niagra Falls, N.Y. It is convenient to place putty 62 at the location indicated by reference numeral 50, though other locations are also possible. Heat-resistant putty 62 helps hold glass block structure 10 together, both under normal conditions and in the event of a fire. In addition, a primary use of putty 62 is for heat protection. It will of course be apparent to one of ordinary skill in the art that other embodiments of the invention may not include heat-resistant putty 62.

Figure 5:
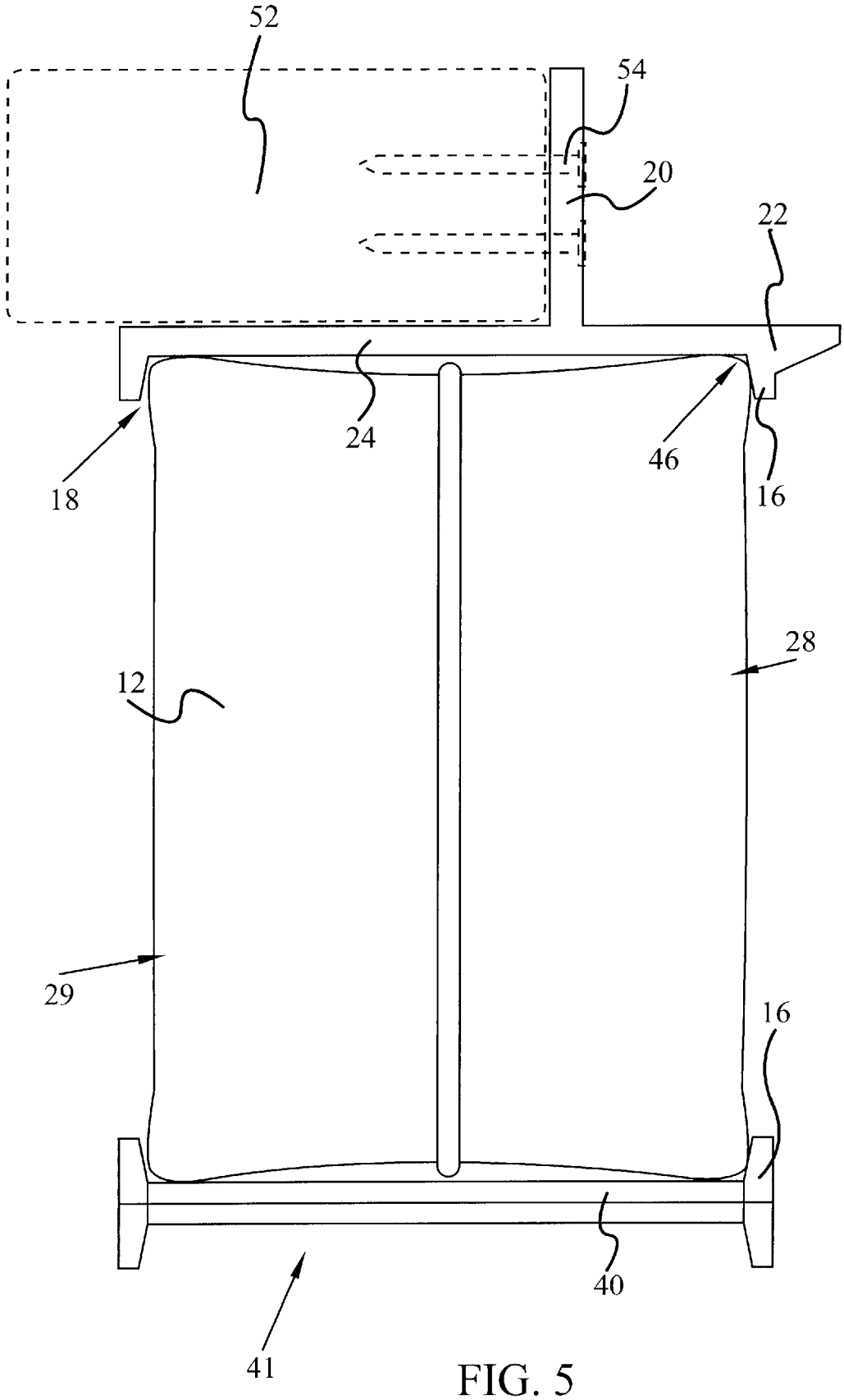
FIG. 5 is a side view of the phenolic resin installation frame showing the location of a glass block.

Referring now to FIG. 5, a glass block 12 and installation frame 18 are shown adjacent to a wall stud 52 in order that the manner of installation of glass block structure 10 may be illustrated. To install glass block structure 10 in a wall of a building, glass block structure 10 is placed into an opening, not shown, in the wall, also not shown, such that nailing fin 20 is flush with wall stud 52. Nails 54 are then driven through nailing fin 20 and into wall stud 52. Nails 54 could be replaced by any other fastening device, such as screws, tacks, or pins. Phenolic resin strip 16 covers corners 46 of glass block 12. Stucco stop or brick molding 22 protrudes out from phenolic resin strip 16 a certain distance, which in one embodiment is 0.590 plus or minus 0.010 inches. The distance from nailing fin 20 to the end of stucco stop or brick molding 22 may be 1.300 plus or minus 0.010 inches. The thickness of nailing fin 20 and of installation frame 18 is 0.100 plus or minus 0.010 inches. As with the other dimensions given earlier, these dimensions are illustrative and not limiting, as other dimensions are also possible for these features, as is the case with all the features of glass block structure 10. Appropriate dimensions may be selected based on well known criteria with which one of ordinary skill in the art would be readily acquainted.

Nailing fin 20 may be adapted to lie flush against the face of a wall stud so that nails may be driven through nailing fin 20 and into the stud, as shown. Stucco stop or brick molding 22 acts as a boundary to which the stucco or other finish on the structure under construction may be brought. The stucco, when brought to the edge of stucco stop or brick molding 22 in this manner, covers and obscures nailing fin 20 from view.

Rear edge support 24 extends along the outer edge of glass block 12 from nailing fin 20 to back face 29. Rear edge support 24 and support pieces 41 perform the same function, namely, they act as a supporting framework that holds an individual glass block 12 in its place with respect to the other glass blocks 12 within glass block structure 10.

The foregoing detailed description has thus described a glass block structure supported by a framework of phenolic resin. This framework is bonded to the individual glass blocks with an adhesive substance that is placed so as to lie at or near the corners of the blocks. The phenolic resin may advantageously be formed in a pultrusion process wherein the resin is embedded with glass-like strands. Further heat-tolerance and adhesion may be obtained from the use of a high-heat tolerant putty applied between the phenolic resin and the glass blocks.

While the invention has been particularly shown and described with reference to specific embodiments thereof, it will be understood by those skilled in the art that various changes in form and details may be made therein without departing from the spirit and scope of the invention.

I claim:

1. A translucent structure comprising:

at least two glass blocks;

at least one flexible pultruded support piece separating said glass blocks and maintaining a distance between said glass blocks, said support piece comprising at least one flexible strip connected to a substantially flat, flexible tray, said tray substantially perpendicular to said strip, the at least one strip and the tray each comprising a phenolic resin embedded with fiberglass strands;

an adhesive substance between at least one of said glass blocks and said support piece;

a high-heat-tolerant putty between at least one of said glass blocks and said support piece; and an installation frame forming a perimeter of said translucent structure, said installation frame comprising a phenolic resin.

2. A translucent structure comprising:

at least two glass blocks;

at least one flexible pultruded support piece separating said glass blocks and maintaining a distance between said glass blocks, said support piece comprising at least one flexible strip integrally joined to a substantially flat, flexible tray, said tray substantially perpendicular to said strip, said support piece located in said translucent structure such that said tray is adjacent to a bottom surface of at least one of said glass blocks and such that at least a portion of said strip is adjacent to a front surface of said at least one glass block, the at least one flexible strip and the tray each comprising a phenolic resin embedded with fiberglass strands, said flexible support piece tending to permit the transportation of said translucent structure from a first location where said structure is assembled to a second location where said structure may be installed by permitting members of said translucent structure to flex and bend slightly with respect to each other without breaking during transportation of said translucent structure;

an adhesive substance between at least one of said glass blocks and said support piece; and a high-heat-tolerant putty between at least one of said glass blocks and said support piece.

3. The translucent structure of claim 2 wherein said at least one flexible strip comprises opposing flexible strips integrally joined to the substantially flat, flexible tray, said tray substantially perpendicular to said strips so that the support piece forms an I-shape in cross-section, said support piece located in said translucent structure such that said tray is adjacent to a bottom surface of at least one of said glass blocks and such that at least a portion of each of said strips is adjacent to a front surface and a back surface respectively of said at least one glass block.

4. A translucent structure comprising:

(1) a plurality of glass blocks including at least a first glass block and a second glass block, said first and second glass blocks being adjacent blocks in said translucent structure, said first glass block having a plurality of surfaces, including at least a first surface, said second glass block having a plurality of surfaces, including at least a second surface, said first surface adjacent to said second surface;

(2) a flexible phenolic resin support framework located between said first and second surfaces;

(3) an adhesive securing said first and second glass blocks to said phenolic resin support framework; and (4) a high-heat-tolerant putty, said putty located between said phenolic resin support framework and at least one of said glass blocks.

5. The translucent structure of claim 4 wherein said phenolic resin support framework is formed in a pultrusion process.

6. The translucent structure of claim 4 wherein said phenolic resin support framework is embedded with glass-like strands.

7. The phenolic resin of claim 6 wherein said glass-like strands are fiberglass.

8. The translucent structure of claim 4 further comprising an installation frame forming the perimeter of said translucent structure.

9. The translucent structure of claim 8 wherein said installation frame is formed of phenolic resin.

10. The translucent structure of claim 8 wherein said installation frame further comprises at least one of: a nailing fin, a stucco stop and a brick molding.

11. The translucent structure of claim 4 wherein said phenolic resin support framework comprises:

(1) a plurality of phenolic resin strips; and (2) a plurality of phenolic resin trays stretching between pairs of said phenolic resin strips, the combination of one of said trays and the attached pair of said strips comprising a single unit, said phenolic resin support framework acting as an insulator such that excessive heat on a first side of said translucent structure does not destroy adhesive on a second side of said translucent structure located opposite said first side.

12. A translucent structure comprising:

(1) a first glass block and a second glass block, said first and second glass blocks being adjacent blocks in said translucent structure, said first glass block having a plurality of surfaces, including at least a first surface, said second glass block having a plurality of surfaces, including at least a second surface, said first surface adjacent to said second surface;

(2) a flexible phenolic resin support piece located between said first and second surfaces;

(3) a high-heat tolerant putty located between said phenolic resin support piece and at least one of said first and second surfaces; and (4) a flexible adhesive securing said first and second glass blocks to said flexible phenolic resin support piece, the flexible adhesive and flexible phenolic resin support piece both configured to permit members of said translucent structure to flex and bend slightly with respect to each other without breaking.

13. A method of forming a translucent structure from a plurality of glass blocks, the method comprising:

(1) adhering with an adhesive and a high-heat tolerant putty a first side of a first flexible pultruded support piece comprising a phenolic resin embedded with fiberglass strands to a first side of a first glass block at an assembly location;

(2) adhering with an adhesive and a high-heat tolerant putty a second side of said first flexible pultruded support piece to a first side of a second glass block at the assembly location, the first flexible pultruded support piece maintaining a distance between said first and second glass blocks; and (3) adhering with an adhesive and a high-heat tolerant putty a flexible installation frame comprising a phenolic resin embedded with fiberglass strands around a perimeter of said plurality of glass blocks at the assembly location, thereby forming the translucent structure.

14. The method of claim 13 further comprising:

(4) transporting as a unit the translucent structure to an installation location different than the assembly location.

15. The method of claim 14 wherein transporting as a unit the translucent structure further comprises said flexible support piece permitting members of said translucent structure to flex and bend slightly with respect to each other without breaking during transportation.

* * * * *